US008240285B2

(12) United States Patent
Hinkovska et al.

(10) Patent No.: US 8,240,285 B2
(45) Date of Patent: Aug. 14, 2012

(54) SWITCHABLE CUP TAPPET

(75) Inventors: Lucia Hinkovska, Herzogenaurach (DE); Sandra Schaefer, Hoechstadt (DE); Lothar Von Schimonsky, Gerhardshofen (DE); Norbert Nitz, Erlangen (DE); Mario Kuhl, Herzogenaurach (DE); Michael Haas, Hoechstadt (DE)

(73) Assignee: Schaeffler Technologies AG & CO. KG, Herzogenaurach (DE)

( * ) Notice: Subject to any disclaimer, the term of this patent is extended or adjusted under 35 U.S.C. 154(b) by 366 days.

(21) Appl. No.: 12/527,670

(22) PCT Filed: Feb. 1, 2008

(86) PCT No.: PCT/EP2008/051245

§ 371 (c)(1),
(2), (4) Date: Aug. 18, 2009

(87) PCT Pub. No.: WO2008/101784

PCT Pub. Date: Aug. 28, 2008

(65) Prior Publication Data

US 2010/0077975 A1 Apr. 1, 2010

(30) Foreign Application Priority Data

Feb. 19, 2007 (DE) ..... 10 2007 008 574

(51) Int. Cl.
*F01L 1/14* (2006.01)

(52) U.S. Cl. ..... 123/90.48; 123/90.52; 123/90.55

(58) Field of Classification Search ..... 123/90.48, 123/90.52, 90.16, 90.55, 90.5
See application file for complete search history.

(56) References Cited

U.S. PATENT DOCUMENTS

| | | | | |
|---|---|---|---|---|
| 2,983,991 | A | 5/1961 | Carlson | |
| 5,782,216 | A * | 7/1998 | Haas et al. | 123/90.16 |
| 5,934,232 | A | 8/1999 | Greene et al. | |
| 2002/0195072 | A1 | 12/2002 | Spath et al. | |
| 2003/0075129 | A1 | 4/2003 | Spath et al. | |

FOREIGN PATENT DOCUMENTS

| | | | |
|---|---|---|---|
| DE | 33 32 455 | Y | 4/1984 |
| DE | 44 33 742 | A | 4/1995 |
| DE | 44 36 952 | Y | 4/1996 |
| DE | 43 14 619 | A | 11/1997 |
| DE | 199 03 492 | A | 8/2000 |
| DE | 44 92 633 | A | 5/2001 |
| DE | 101 19 366 | A | 10/2002 |
| DE | 102 04 672 | Y | 8/2003 |

(Continued)

*Primary Examiner* — Zelalem Eshete
(74) *Attorney, Agent, or Firm* — Lucas & Mercanti, LLP; Klaus P. Stoffel

(57) ABSTRACT

A switchable bucket tappet for a valve drive of an internal combustion engine, which has a bucket basic body with a ring-like base. A hollow-cylindrical projection protrudes from an inner edge of the base, and in the bore of the projection an inner body extends. Two coupler pistons lie opposite one another and, to achieve full valve stroke, engage in sections with a driver surface of the bucket basic body which run in a radial hole of the inner body. A zero valve stroke is achieved when the coupler piston is displaced completely into the radial hole of the inner body, which is baseless and free of contact with a cam. The projection has a window-like aperture, with the underside acting as the driver surface for an upper side of the coupler piston during coupling. The region of the base is an approximately symmetrical and continuously thin-walled formation.

16 Claims, 3 Drawing Sheets

FOREIGN PATENT DOCUMENTS

| | | | |
|---|---|---|---|
| DE | 198 80 979 | Y | 4/2004 |
| DE | 10 2005 030 718 | Y | 1/2007 |
| GB | 898 599 | Y | 6/1962 |
| JP | 61 118514 | Y | 6/1986 |
| JP | 61 1 75 203 | Y | 8/1986 |
| JP | 63 0 75 303 | Y | 4/1988 |
| WO | 03/067038 | Y | 8/2003 |

* cited by examiner

SWITCHABLE CUP TAPPET

This application is a 371 of PCT/EP2008/051245 filed Feb. 1, 2008, which in turn claims the priority of DE 10 2007 008 574.7 filed Feb. 19, 2007, the priority of both applications is hereby claimed and both applications are incorporated by reference herein.

FIELD OF THE INVENTION

The invention relates to a switchable bucket tappet for a valve drive of an internal combustion engine, having a bucket basic body which has a ring-like base and which can be guided, by means of its skirt which projects from the outer edge of the base, in a bore of the internal combustion engine, which base can be acted on by at least one lifting cam, with a hollow cylindrical extension projecting from an inner edge of the base, in the bore of which extension runs an inner body which is axially movable relative to the bucket basic body and whose underside has formed in it an abutment for at least indirect contact with the gas exchange valve, with two opposite coupling pistons running in a radial bore of the inner body, which coupling pistons, in order to obtain a full valve lift, can be placed in engagement in sections with a driver surface of the bucket basic body, and with a lost motion spring acting between the bucket basic body and inner body.

BACKGROUND OF THE INVENTION

A bucket tappet of said type can be gathered from DE 44 92 633 C1, which is regarded as being generic. Said bucket tappet is formed as a switchable bucket tappet whose coupling mechanism is arranged directly below the base. A person skilled in the art will recognize that the already known tappet is of relatively complex design, and the production thereof has therefore proven to be unnecessarily expensive. For example, the outer part is of asymmetrical design in the base region, since guide bores for the coupling piston are formed below the annular base. It can also be seen that the inner part is of unnecessarily massive design, in particular in the base region. Said massive design is associated with an undesired increase in the oscillating valve drive masses. Furthermore, on account of the piston-in-bore coupling, relatively high component loading can occur in the coupling section.

OBJECT OF THE INVENTION

It is therefore an object of the invention to create a bucket tappet of the above-mentioned type in which the stated disadvantages are eliminated, which can, in particular, be produced in a cost-effective manner, and which has a simplified, reliable coupling mechanism.

Achievement of the Object

According to the invention, said object is achieved in that a zero valve lift is obtained when the coupling pistons are moved completely into the radial bore of the inner body, with the inner body being formed, without a base, so as to be entirely free from contact with the cam or base circle, with the hollow cylindrical extension having, on the side of the respective coupling piston, either a window-like through hole or, at its lower edge, a half-window-like recess, with an underside of the through hole or recess functioning as the driver surface for a respective upper side of the coupling piston in the coupled state, which through hole or recess is situated at an axial distance from the region of the base of the bucket basic body, which region of the base is of virtually symmetrical and entirely thin-walled design, and with an anti-twist device being formed between the inner body and the bucket basic body.

The stated disadvantages are hereby eliminated. As a result of the at least substantially symmetrical design without guide bores in the base of the bucket basic body, the production of the latter is simplified and made cheaper, and its mass is reduced. Furthermore, since the switchable bucket tappet is proposed as a disengageable tappet, only at least one large-lift cam (but preferably two large-lift cams) is required in the cam region. If appropriate, the measures according to the invention may also be used with bucket tappets whose inner body is provided with a base for making contact with a low-lift or zero-lift cam.

On account of the proposed coupling into a window-like through hole or under a half-window-like recess at the lower edge of the extension, it is possible to dispense with the formation of a fully encircling coupling surface such as an annular groove in the extension, which may unnecessarily weaken the material.

In the event that coupling takes place not into the window, but rather under the lower edge of the extension, said recess may, for example, be provided as a shell-shaped molded portion, which therefore encompasses the coupling pistons, which are then of complementary design at least in said region, in sections at the outer casings thereof. If appropriate, the lower edge may also be formed in the manner of a crown or the like to form the half-window-like recess.

On account of the two diametrically oppositely arranged coupling pistons, wherein the invention may, if appropriate, also be realized with only one or with more than two coupling pistons, secure coupling is provided in the coupled state with only relatively low contact pressure. Complex, mass-increasing guides for coupling pistons in the base region of the bucket basic body, as provided in the prior art, are not required, since the cylindrical section which is situated a considerable distance below the base region in any case is used for coupling.

For the required anti-twist device between the bucket basic body and the inner body, consideration is given, in one expedient refinement of the invention, for example, to a circlip or the like which is inserted into an annular groove of the bore of the extension, the radially inwardly directed ends of which may run in a longitudinal slot on the outer casing of the inner body. Conversely, it is also conceivable for a ring of said type to be attached to the outer casing of the inner body, and to then be arranged with a radially outwardly projecting end piece in a longitudinal groove of the bore of the extension. Alternative options here would, however, also be components such as pins, balls etc. which act between the two elements.

It is particularly preferable for the inner body to be of substantially hollow cylindrical tubular design and to be provided with the corresponding radial bore for the coupling pistons only by means of an approximately central annular web. Although the radial bore should preferably be formed as a through bore, it is, however, also conceivable to provide two diametrically oppositely situated blind bores, with it then being necessary for the pistons to each be assigned a separate pressure spring in order to move said pistons in the coupling direction.

In the case of a continuous radial bore being provided for the coupling pistons, a central stop is expediently provided for said coupling pistons by means of a stop ring or pin or the like which is fitted centrally in their radial bore.

On account of the above-specified design, the mass of the inner body is considerably reduced in relation to the prior art, and the production of said inner body is also simplified. Said inner body may, for example, be produced in an extrusion process, though consideration is also given to producing said inner body in massive form or by forming processes. If appropriate, it is also possible for two tubular cylindrical sections to be formed separately and connected by means of a third, central component.

By dispensing with a run-on base for a low-lift cam in the base region of the inner tappet, grinding work for creating said surface is therefore also dispensed with, and it is possible to dispense with the cam, which would run against such a run-on base, on the camshaft.

According to one refinement of the invention, it is proposed that a movement of the pistons in their coupling direction be provided, as stated, by means of the force of a pressure spring, which at least one spring can abut against an inner face of the coupling pistons in each case. In contrast, it is proposed that a movement in the decoupling direction (radially inward) be effected by means of hydraulic medium which can be conducted via suitable passages in the skirt. It is however also conceivable and provided, for the coupling pistons to be moved in their coupling direction hydraulically and for at least one spring to be used in the decoupling direction, or alternatively, the coupling pistons can be acted on hydraulically in both of their movement directions.

As a result of the spherical outer faces of the coupling pistons, as proposed in one refinement of the invention, said coupling pistons can be pushed back again into their radial bore without significant loads in the event of incorrect operation (for example only deployed slightly despite coupling demand being triggered).

Further subclaims relate to simple measures for setting a coupling or locking play. Accordingly, it is provided, for example, that a pack of securing rings be attached to a cylindrical section, which runs above the annular web of the inner body, one of which rings, for example, may be provided in a range of different thicknesses in a manner known per se during assembly. A region of the inner edge of the base of the bucket basic body may then abut against an underside of said ring pack.

Alternatively, a coupling play may also be set by means of only one securing ring which may be provided in a range of different thicknesses, in a manner known per se. Said design may also simultaneously serve generally to provide travel limitation and captive retention. It is also possible instead of the one or two securing rings to provide other components, such as pins, balls or the like, which act radially between the elements.

Further subclaims relate to expedient embodiments of the window-like through holes in the hollow cylindrical extension or of the half-window-like recesses in said extension.

In a first physical embodiment, it is proposed that the window-like through hole for the respective coupling piston be formed as a single, continuous bore, into which the coupling piston, which may of be completely cylindrical design, then engages in the coupled state. Instead of a bore as a window-like through hole, it is also possible to provide a rectangular cross section into which a piston, which is flattened on its upper side, then engages. Other polygonal coupling contours are also conceivable, and provided, if appropriate.

In the case of coupling of the coupling pistons under the lower edge of the extension, said coupling pistons are expediently cylindrical (at least on their upper side) and, in the coupled state, engage into the half-window-like recess, which is formed as a shell-shaped molded portion, in said region.

With the coupling measures specified above with flattened coupling pistons, it may be assumed that the contact pressure, in the coupled state, is particularly expedient, such that components may be dimensioned with thinner walls, if appropriate.

Further subclaims relate to measures for conducting hydraulic medium to a point in front of radially outer faces of the coupling pistons in the above-specified coupling variants.

A thin-walled element such as a sheet-metal or plastic part should thus preferably be applied in the interior of the bucket basic body, into which thin-walled element corresponding ducts for conducting hydraulic medium are then formed. Said ducts may also be provided so as to be distributed about the circumference in the base region, with an optionally separate axial duct radially at the inside then extending downward from each individual duct into an annular chamber, which is formed in the corresponding section of the annular part, in front of outer faces of the coupling pistons.

To create a smooth abutment for one end of the required lost motion spring (helical pressure spring or helical pressure spring pack), an annular part is provided between said spring and an underside of the element.

On account of the proposed ventilation bore at least indirectly into the open space in the "downward" direction, an "inflation" caused by the coupling pistons during their radially inward movement is prevented. If appropriate, said ventilation opening may also extend upward.

As stated, at a level of the coupling pistons, the thin-walled element simultaneously advantageously delimits an annular chamber in front of the end sides of the coupling pistons.

It is also proposed that the region below the annular web of the inner body be designed such that a hydraulic play compensating device of known design can be arranged in said region or such that a play compensating element of said type is arranged in said region, the pressure piston of which play compensating element is then in direct contact with the gas exchange valve. Alternatively, the disengageable bucket tappet may also be designed so as to act purely mechanically, In the variant in which the respective coupling piston has a flattened portion on its upper side for coupling under a likewise flat window surface, the coupling pistons are provided with an anti-twist device. Here, consideration is given, for example, to a securing ring which is placed on the flattened portion of said coupling piston, a pin which engages into said securing ring, a ball or the like.

BRIEF DESCRIPTION OF THE DRAWINGS

The invention is expediently explained in more detail on the basis of the drawing, in which.

DETAILED DESCRIPTION OF THE DRAWINGS

Figure 1:
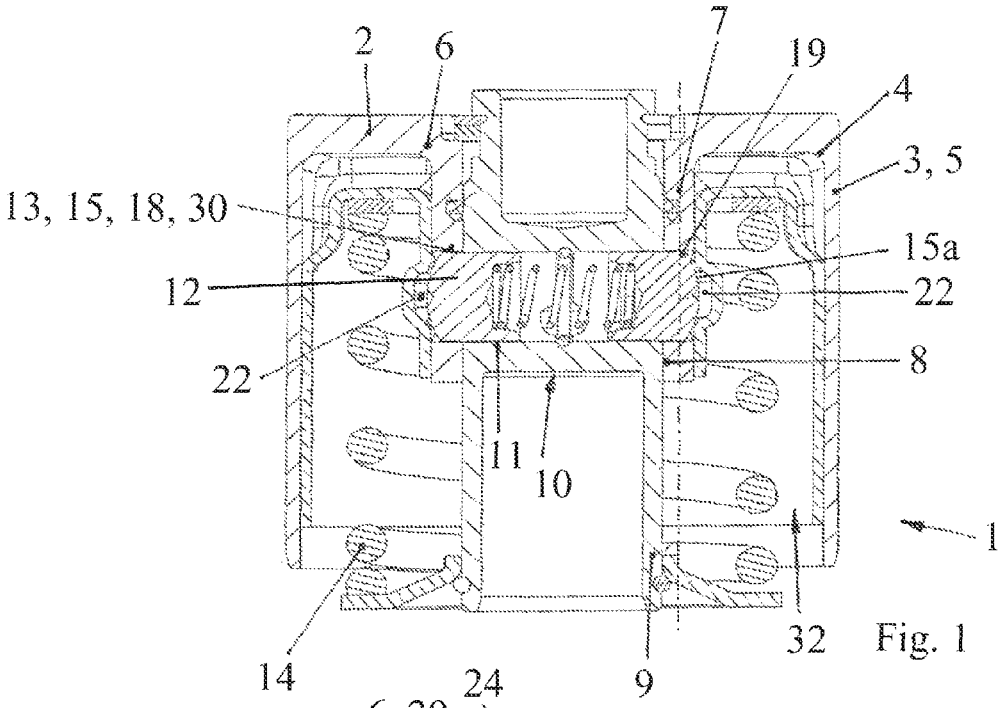
FIG. 1 shows a longitudinal section through a disengageable bucket tappet having a window-like through hole, which is designed as a bore, in the extension.
Figure 2:
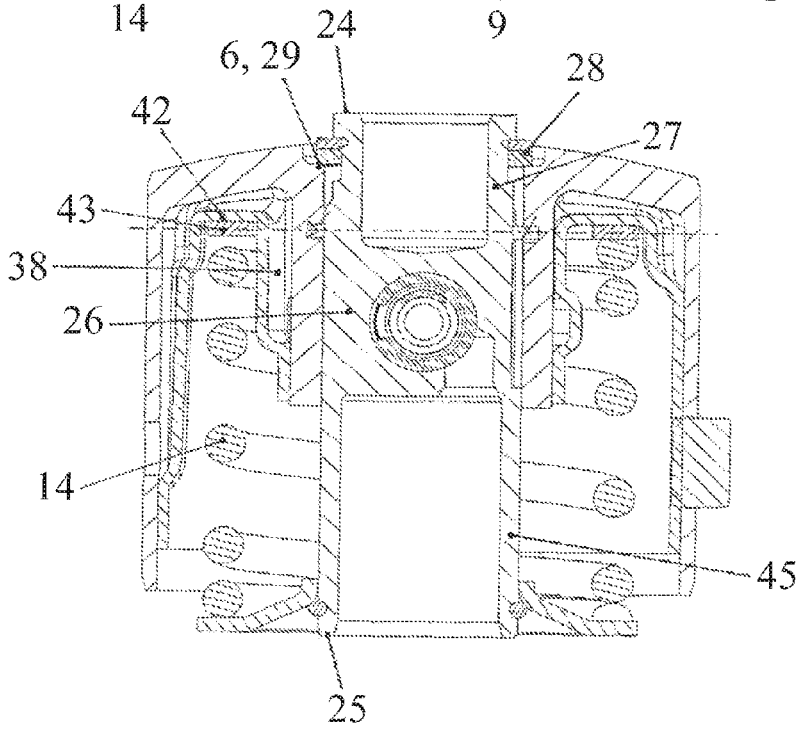
FIG. 2 shows a sectioned view, rotated by 90°, according to FIG. 1.

The figures illustrate a switchable bucket tappet 1 for a valve drive of an internal combustion engine. Said bucket tappet 1 is designed such that it can be fully disengaged from the cam lift. The bucket tappet 1 is composed of a bucket basic body 3 which is closed off at the cam side by a ring-like base 2. A hollow cylindrical skirt 5 projects from an outer edge 4 of the base 2. By means of an outer casing of said skirt 5, the bucket tappet 1 can be arranged in an oscillating fashion in a receptacle (not illustrated in the drawing) of the internal combustion engine.

As can be seen for example from FIG. 1, the base 2 is formed so as to be cylindrically arched in the cam profile direction. Said base 2 expediently comes into contact with two spaced-apart high-lift cams.

A hollow cylindrical extension 7 projects from an inner edge 6 of the base 2. Said extension 7 has a bore 8 in which runs an inner body 9 as a further essential constituent part of the bucket tappet 1. The inner body 9 is designed so as to be axially movable relative to the bucket basic body 3. Said inner body 9 acts with an underside 10 at least indirectly on one or more gas exchange valves in a lifting sense. If appropriate, said inner body 9 may communicate with the gas exchange valve via a hydraulic play compensating element (not illustrated in the drawing) which is installed in said inner body 9.

A bore 8 of the extension 7 of the bucket basic body 3 therefore serves as a guide for an outer casing 41 of the inner body 9, which is composed of an upper and a lower cylindrical section 27, 45, and which is divided by an annular web 26. It can be seen that the inner body 9, as a result of its tubular design, is of very simple design, need not have a base and does not make contact with a cam.

A bore 11 which extends radially in a continuous fashion runs in said annular web 26. Two coupling pistons 12 are situated opposite one another in said bore 11, the radially outer faces 15*a* of which coupling pistons 12 are of spherical design. The coupling pistons 12 are acted on in their coupling direction by means of the force of at least one spring 21 which acts against the inner faces 20 of said coupling pistons 12. A central stop ring (not shown) ensures a defined decoupled state of the coupling pistons 12 in the bore 11.

All the figures illustrate the coupled state of the coupling pistons 12. As can be seen in more detail from FIG. 1, two window-like through holes 15 are formed in the extension 7, which through holes 15 are formed here as continuous bores 30. The bores 30 can be produced in a very simple manner in terms of production. For the required anti-twist device between the bucket basic body 3 and inner body 9, it is possible, as shown in FIG. 6, for a circlip to be inserted in an annular groove 47 in the bore 8 of the extension 7, which circlip runs with its inwardly directed, open end 48 in a respective longitudinal slot 49 in the outer casing 41 of the extension 7.

Decoupling of the bucket tappet 1 takes place by means of hydraulic medium pressure. In order to dispense with the formation of corresponding ducts into the skirt 5 and into the base 2, a thin-walled element 33 is applied in the interior 32 of the bucket basic body 3. Said thin-walled element 33 may, for example, be formed from sheet metal by means of a shaping process. As can be seen from the figures, the element 33 substantially follows an inner wall of the bucket basic body 3. Here, an aperture 34 is drilled into the skirt 5. Proceeding from said aperture 34, a rising duct 35 is formed in the element 33, which rising duct 35 is fluidically connected axially at the top to preferably a plurality of radial passages 36 at an underside 37 of the base 2 in the element 33 (see FIG. 6).

The radial passages 36 communicate radially at the inside with at least one axial duct 38. Said axial duct is likewise formed into the element 33 and runs between an outer casing 39 of the extension 7 and the element 33 in the direction away from the base. The axial duct 38 ends in an annular chamber 22, which is formed into the element 33, for the hydraulic medium directly in front of the radially outer faces 15*a* of the coupling pistons 12.

Figure 6:
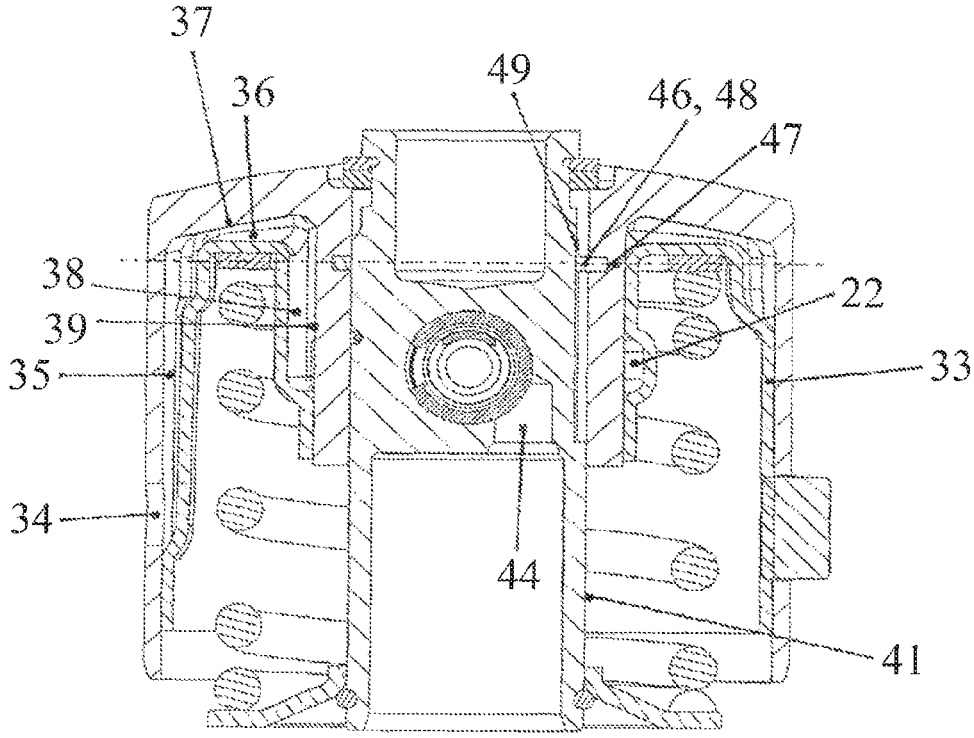
FIG. 6 shows a sectioned view, rotated by 90°, according to FIG. 5.

FIG. 6 also shows that the bore 11 in the inner body 9 is intersected approximately centrally by a ventilation opening 44, such as a bore, in the downward direction.

Figure 3:
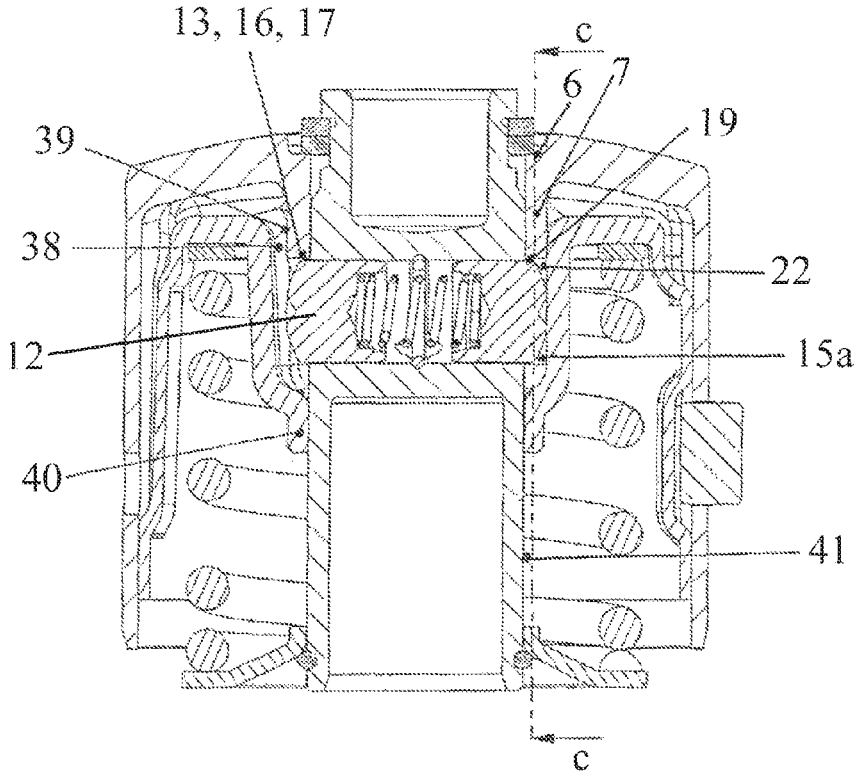
FIG. 3 shows a bucket tappet similar to that in FIG. 1, but with a half-window-like recess at the lower edge for the purpose of coupling.
Figure 4:
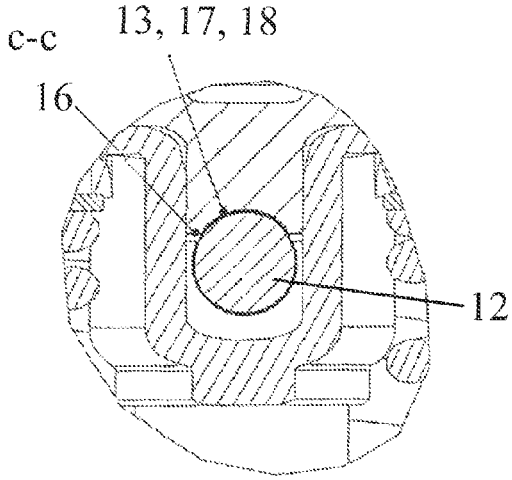
FIG. 4 shows a section along the line C-C in FIG. 3.

In FIG. 3, the coupling pistons 12 are again of cylindrical design, but engage in each case into a half-window-like recess 17 at the lower edge 16 of the extension 7 (see also FIG. 4). The recess 17 is formed here as a shell-shaped molded portion. If appropriate, other engagement geometries, such as polygonal engagement geometries, are also conceivable and provided in said region.

Figure 5:
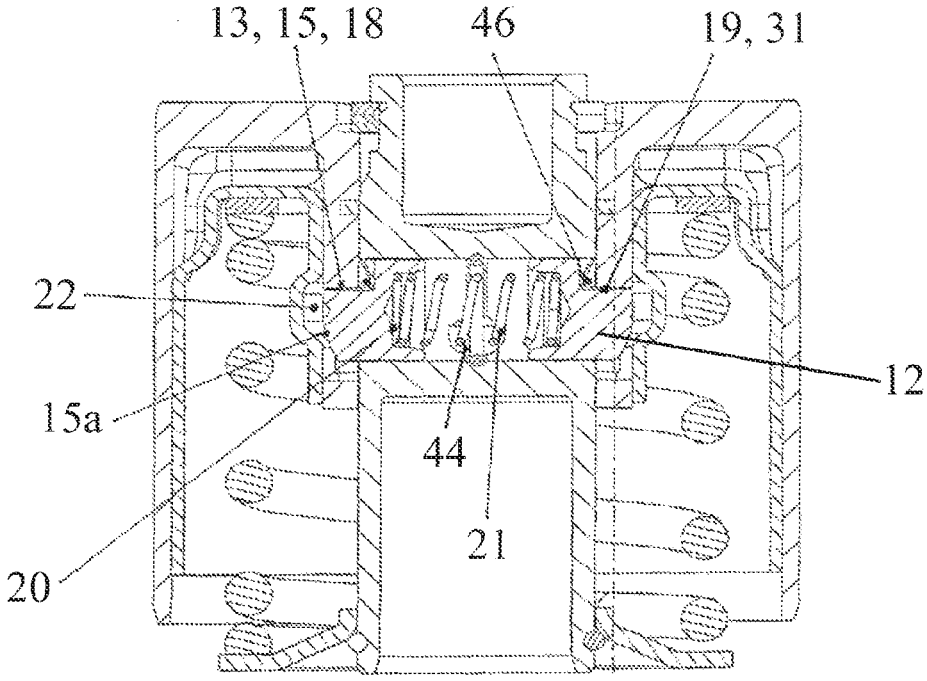
FIG. 5 shows a bucket tappet as specified above, having window-like through holes in the extension and flattened coupling pistons.

FIGS. 5, 6 show a further alternative embodiment in the coupling region. Accordingly, although the coupling pistons 12 here are provided with a cylindrical casing region for guidance in their bore 11, said coupling pistons 12 have, proceeding from their radially outer face 15*a*, in each case one flattened portion 31 on their upper side 19. In the coupled state, said coupling pistons 12 engage with said flattened portion 31 under a likewise flat underside 18 of the in this case window-like through hole 15 in the extension 7. If appropriate, the upper side 19 of the coupling piston 12 may also be of slightly spherical or cylindrically arched design.

To generate a required coupling play (coupling play =idle travel covered by the bucket basic body 3 during coupling and at the beginning of a cam lift until abutting the upper side 19 of the coupling pistons 12), two securing rings which are situated one above the other are attached, as a height stop element 28, in a groove on the outer casing 41 of the inner body 9, against the underside 29 of which height stop element 28 the bucket basic body 3 abuts with a section of its inner edge 6. One of the two rings (particularly preferably the upper one) as a height stop 28 may preferably be provided in an assortment of thicknesses during assembly.

LIST OF REFERENCE SYMBOLS

1 Bucket tappet
2 Base
3 Bucket basic body
4 Outer edge
5 Skirt
6 Inner edge
7 Extension
8 Bore, extension
9 Inner body
10 Underside
11 Bore, inner body
12 Coupling piston
13 Driver surface
14 Lost motion spring
15 Window-like through hole
15*a* Outer face
16 Lower edge
17 Half-window-like recess
18 Underside
19 Upper side
20 Inner face

21 Spring
22 Annular chamber
23 not assigned
24 Upper end surface
25 Lower end surface
26 Annular web
27 Cylindrical section
28 Height stop element
29 Underside
30 Bore
31 Flattened portion
32 Interior
33 Element
34 Aperture
35 Rising duct
36 Radial passage
37 Underside
38 Axial duct
39 Outer casing
40 Region
41 Outer casing
42 Underside
43 Annular part
44 Ventilation opening
45 Cylindrical section
46 Anti-twist device
47 Annular groove
48 End
49 Longitudinal slot

The invention claimed is:

1. A switchable bucket tappet for a valve drive of an internal combustion engine, comprising:

a bucket basic body having a ring-like base being guided by a skirt projecting from an outer edge of the ring-like base in a bore of the internal combustion engine and a hollow cylindrical extension projecting from an inner edge of the ring-like base, the ring-like base having a region which is substantially symmetrical and an entirely thin-walled design and the ring-like base being acted on by at least one lifting cam;

an inner body, which has a radial bore and an underside with an abutment formed in the underside for at least indirect contact with a gas exchange valve, running in the bore of the hollow cylindrical extension and being axially movable relative to the bucket basic body;

two opposite coupling pistons running in a radial bore of the inner body, the coupling pistons, in order to obtain a full valve lift, being placed in engagement in sections with a driver surface of the bucket basic body; and a lost motion spring acting between the bucket basic body and inner body, wherein a zero valve lift is obtained when the coupling pistons are moved completely into the radial bore of the inner body, the inner body being formed, without a base, so as to be entirely free from contact with the cam or base circle, wherein the hollow cylindrical extension has a window-like through hole extending through a sidewall of the hollow cylindrical extension or, at a lower edge of the hollow cylindrical extension, a half-window-like recess, wherein the through hole or the window-like recess has an underside functioning as the driver surface for an upper side of the coupling pistons in a coupled state, and the through hole or the window-like recess is situated at an axial distance from the base of the bucket basic body, and wherein an anti-twist device is formed between the inner body and the bucket basic body.

2. The bucket tappet as in claim 1, wherein the coupling pistons is moved in the coupling direction by a force of at least one spring which bears against a radially inner faces of the coupling pistons, with a movement in a decoupling direction of the coupling pistons being affected by means of a hydraulic medium, which is conducted into an annular chamber in front of radially outer faces of the coupling pistons.

3. The bucket tappet as in claim 2, wherein radially outer faces of the coupling pistons are of spherical design.

4. The bucket tappet as in claim 1, wherein the inner body is of substantially thin-walled, tubular design, with an annular web, in which the coupling pistons are arranged running at a distance from end surfaces at both ends of the inner body.

5. The bucket tappet as in claim 4, wherein one or two securing rings situated one above the other are provided as a height stop element on a cylindrical section, which runs above the annular web, of the inner body, against an underside of the height stop element abuts a region of an inner edge of the ring-like base of the bucket basic body, wherein when one securing ring is used, the one securing ring is provided in a range of different thicknesses in order to set a coupling play, or when two securing rings are used, at least one is provided in a range of different thicknesses in order to set the coupling play.

6. The bucket tappet as in claim 1, wherein the window-like through hole in the hollow cylindrical extension is a continuous bore, with the coupling pistons being completely cylindrical.

7. The bucket tappet as in claim 1, the hollow cylindrical extension is formed, from the inner edge of the ring-like base, as a short annular collar having a height lower than half the height of the skirt and which, at the lower edge, has the half-window-like recess per each of the coupling pistons, the window-like recess being a shell-shaped molded portion, with the coupling pistons being completely cylindrical.

8. The bucket tappet as in claim 1, wherein the window-like through hole in the hollow cylindrical extension is of rectangular or polygonal design, with the coupling pistons being provided, proceeding from a radially outer face, with a flattened portion on the upper side, by means of the flattened portion the coupling pistons being placed in engagement, in the coupled state, with a flat underside of the window-like through hole.

9. The bucket tappet as in one of claim 6, wherein a thin-walled element, is applied in an interior of the bucket basic body, the element substantially follows an inner contour of the bucket basic body, with at least one rising duct for hydraulic medium being formed, proceeding from at least one aperture in the skirt, between the aperture and the element, the rising duct is connected to at least one tubular radial passage between an underside of the ring-like base and the element, with the at least one radial passage being connected radially at an inside to at least one axial duct, which, between an outer casing of the hollow cylindrical extension and the element, is guided in a direction away from the ring-like base, wherein in a region remote from the ring-like base, the element radially outwardly delimits an annular chamber for a hydraulic medium directly in front of the through hole or the window-like recess.

10. The bucket tappet as in claim 9, wherein the element sealingly bears against the outer casing of the hollow cylindrical extension axially below the through hole, with the annular chamber being formed as a radial molded portion in the element, an inner side of which limits travel of the coupling pistons.

11. The bucket tappet as in claim 9, wherein the element, at the outer casing of the hollow cylindrical extension, extends axially beyond the lower edge of the hollow cylindrical extension and, with a radially contracted region, bears against an outer casing of the inner body below the coupling pistons in the coupled state.

12. The bucket tappet as in claim 9, wherein each of the at least one radial passage in the base is distributed about a circumference in a stellate fashion, and is formed as a duct-like molded portions, which points in a direction away from the ring-like base, in the element, with an annular part as an abutment for one end of the lost motion spring running on an underside of each of the at least one radial passage.

13. The bucket tappet as in claim 1, wherein a ventilation opening which intersects the radial bore of the inner body leads away approximately centrally from the radial bore in a direction away from the ring-like base.

14. The bucket tappet as in of claim 3, wherein a hydraulic play compensating element is installed in a cylindrical section, which runs below an annular web, of the inner body.

15. The bucket tappet as in of claim 8, wherein the coupling pistons are guided in the bore of the inner body by means of an anti-twist device which lies on the flattened portion of the coupling pistons, and the annular part runs concentrically with respect to an axial line of the bucket tappet.

16. The bucket tappet as in claim 1, wherein the anti-twist device between the inner body and the bucket basic body is a circlip which is inserted into an annular groove of the bore of the hollow cylindrical extension and whose radially inwardly directed ends run in a longitudinal slot on an outer casing of the inner body, or in that a pin, a ball or a tongue-and-groove connection is provided.

* * * * *